United States Patent [19]

Bernard

[11] 4,340,176

[45] Jul. 20, 1982

[54] ALL-PURPOSE MOBILE SCOURING MACHINE

[75] Inventor: Jacques Bernard, Lamorley, France

[73] Assignee: Asnets, Paris, France

[21] Appl. No.: 140,112

[22] Filed: Apr. 14, 1980

[30] Foreign Application Priority Data

Apr. 18, 1979 [FR] France ..... 79 09700
Mar. 7, 1980 [FR] France ..... 80 05125

[51] Int. Cl.[3] ..... B05B 3/14

[52] U.S. Cl. ..... 239/102; 239/135; 239/287

[58] Field of Search ..... 239/101, 102, 135, 264, 239/225, 287, 380; 134/13, 172, 173, 180, 181; 15/320, 354

[56] References Cited

U.S. PATENT DOCUMENTS

| | | | |
|---|---|---|---|
| 3,690,559 | 9/1972 | Rudloff | 134/172 X |
| 3,726,481 | 4/1973 | Foster et al. | 239/287 |
| 3,987,964 | 10/1976 | Pittman et al. | 239/287 X |
| 4,219,155 | 8/1980 | Goerss | 239/264 X |

FOREIGN PATENT DOCUMENTS

| | | | |
|---|---|---|---|
| 2190981 | 6/1973 | France | 239/287 X |

*Primary Examiner*—Robert B. Reeves
*Assistant Examiner*—Gene A. Church
*Attorney, Agent, or Firm*—Oblon, Fisher, Spivak, McClelland & Maier

[57] ABSTRACT

An all purpose mobile scouring machine includes a rolling carriage on which is arranged at least one slider carrying a battery of nozzles parallel to one another supplied with fluid under high pressure. The slider is arranged to be driven with continuous to-and-fro movement on a horizontal axle transverse to the carriage, this movement being effected on each side of a median position and driven by a suitable motor. The machine includes at least one nozzle-holder apron, at least two cross-members on which each of the nozzles is pivotably fixed, the assembly of the nozzles of each apron thus being continually movable, in the manner of a deformable parallelogram, in one direction and then in the other, on corresponding oscillating movement of the slider.

16 Claims, 6 Drawing Figures

ALL-PURPOSE MOBILE SCOURING MACHINE

BACKGROUND OF THE INVENTION

1. Field of the Invention

The present invention relates to an all purpose cleaning or scouring machine, designed more especially for cleaning industrial floors, such as metal floors, grids, and gratings.

2. Description of the Prior Art

It has already been proposed, notably for cleaning gratings, to use a nozzle, generally to be handled by hand and applying the erosive and the abrasive action of a jet of fluid under a high pressure, of the order of 600 bars, with a relatively modest delivery rate, of the order of 20 liters per minute. The efficiency of such a tool is feeble, notably by reason of the time factor involved.

As regards the cleaning of gratings, other machines have also been proposed, machines similar to lawn mowers, and supplied with compressed air or water under pressure, at a delivery rate and at a pressure which are substantially equivalent with what has just been mentioned.

The results are no more satisfactory, any more than those obtained with machines with a rotary jet.

Hence it was often necessary to proceed with the dismounting of the gratings to be cleaned, which were subjected to scouring with soda, and then replaced them in position, an operation which obviously was long, tedious, difficult and expensive in time and labour.

GENERAL DESCRIPTION OF THE INVENTION

Accordingly it is an object of the present invention to provide an all-purpose scouring machine, which comprises a travelling carriage arranged to receive a movable slider bearing an array or battery of lances or nozzles supplied with fluid at very high pressure through a suitable distributor.

According to the invention there is provided a all purpose scouring machine comprising at least one nozzle-holding apron with at least two cross-members on which each of the nozzles is pivotably fixed, the set of nozzles of each apron thus being made continually movable, like a deformable parallelogram, in one direction and then in the other, on corresponding oscillating movement of the slider.

According to a further feature of the invention, said slider includes two arms directed towards the front of the machine and designed to support the aprons which are included in the battery of nozzles, each arm being assembled to each of the aprons by means of an articulation with several degrees of freedom, each of these articulations including a pivoting block bearing in the first place an axle perpendicular to the plane of the aprons, which cooperates with one of the uprights of the corresponding apron, all the nozzles of the same apron pivoting simultaneously on their assembly points with each of the cross-members, said pivoting block including in the second place a housing designed to receive the pivoting axle integral with the corresponding arm of the slider, the direction of said housing being substantially horizontal and perpendicular to said axle of the block, the amplitude of the pivoting movement being at least 30° on each side of the median position of the device.

According to another feature of the machine according to the present invention, it is movable in the direction of the advance by means of the travelling carriage which it includes, enabling at the same time continual transverse to-and-fro movement of the nozzles, as well as several adjustments of the latter, as will be described more fully below.

According to another feature, the carriage of the machine can include, at the front, two fixed wheels, and at the rear, at least one steering wheel. It can be manoeuvred by hand or be self-driven, in which case a seat for the driver is provided at the rear part of said carriage.

A distributor mounted on the carriage, receives the fluid under pressure, immediately redistributed between the various nozzles of the machine. This fluid may be water at very high pressure, of the order of 1000 bars for example; scouring or detergent additives may be included therein.

The oscillating to-and-fro motion is communicated by a suitable motor, to a slider, guided by at least one substantially horizontal slide, integral with the carriage. Said slider includes at its front part two arms bearing the battery of nozzles, which battery comprises one or several parallel aprons each of which includes horizontal cross-members on which said nozzles are fixed.

According to the invention, the motor which communicates the aforesaid oscillating to-and-for motion may be a mechanical system, an electric motor, a pneumatic motor, a pivoting jack or a double-acting jack, for example. In the case where a jack is used, the machine is advantageously equipped with means for interrupting the compressed air supply of the jack.

Independently of the aforesaid to-and-fro motion, various adjustments of the nozzles are possible.

Thus due to suitable articulation systems, it is possible to confer to the one or more nozzle-holding aprons, slope with respect to the vertical by an angle of about 30° forwards, or, if necessary rearwards.

On the other hand, the nozzles being normally perpendicular to the cross-members which support them, may also be simultaneously inclined with respect to these same cross-members, the cross-members-nozzles assembly then behaving like deformable parallelograms.

According to another feature of the invention, the all-purpose scouring machine instead of including a single nozzle-holding slider, includes two of them, for the purpose of balancing the motion of the movable mechanisms constituted by said two sliders.

According to another embodiment of the scouring machine according to the invention, a fixed cross-member is also provided at the upper part of the machine, this cross-member bearing as many notches as there are nozzles, each of them becoming engaged in a notch, which constitute, in a way, a fixed point for the corresponding nozzle, when the latter is driven with a continuous angular oscillating motion.

According to a further feature of the invention, the pivoting of each nozzle around the movable cross-member forming part of the corresponding apron, is obtained by means of two half-sleeves of which one includes an axle pivotable inside a barrel itself fixed permanently to the cross-member of the apron.

For its part, each cross-member is also pivotably mounted by means of a suitable block around a horizontal transverse axle integral with the first nozzle-holding slider.

Each of the two sliders is driven pivotably by a suitable arm hinged to a yoke borne by the corresponding slider, these two arms being pivotably mounted in two parallel planes around the same vertical axle situated at the rear of the machine, the control of these pivoting movements being obtained by a common vertical shaft driving two suitable cams, one per arm, the angular staggering of these cams being adjustable at will according to the compensation that it is desired to give to the respective movement of the two sliders. The control shaft is driven by a motor which can, if necessary, be a hydraulic or pneumatic jack.

Besides the foregoing features, the invention comprises further features which will emerge from the description which follows.

BRIEF DESCRIPTION OF THE DRAWINGS

The invention will be better understood by means of the additional description which follows, with reference to the accompanying drawings in which.

DESCRIPTION OF PREFERRED EMBODIMENTS

Figure 1:
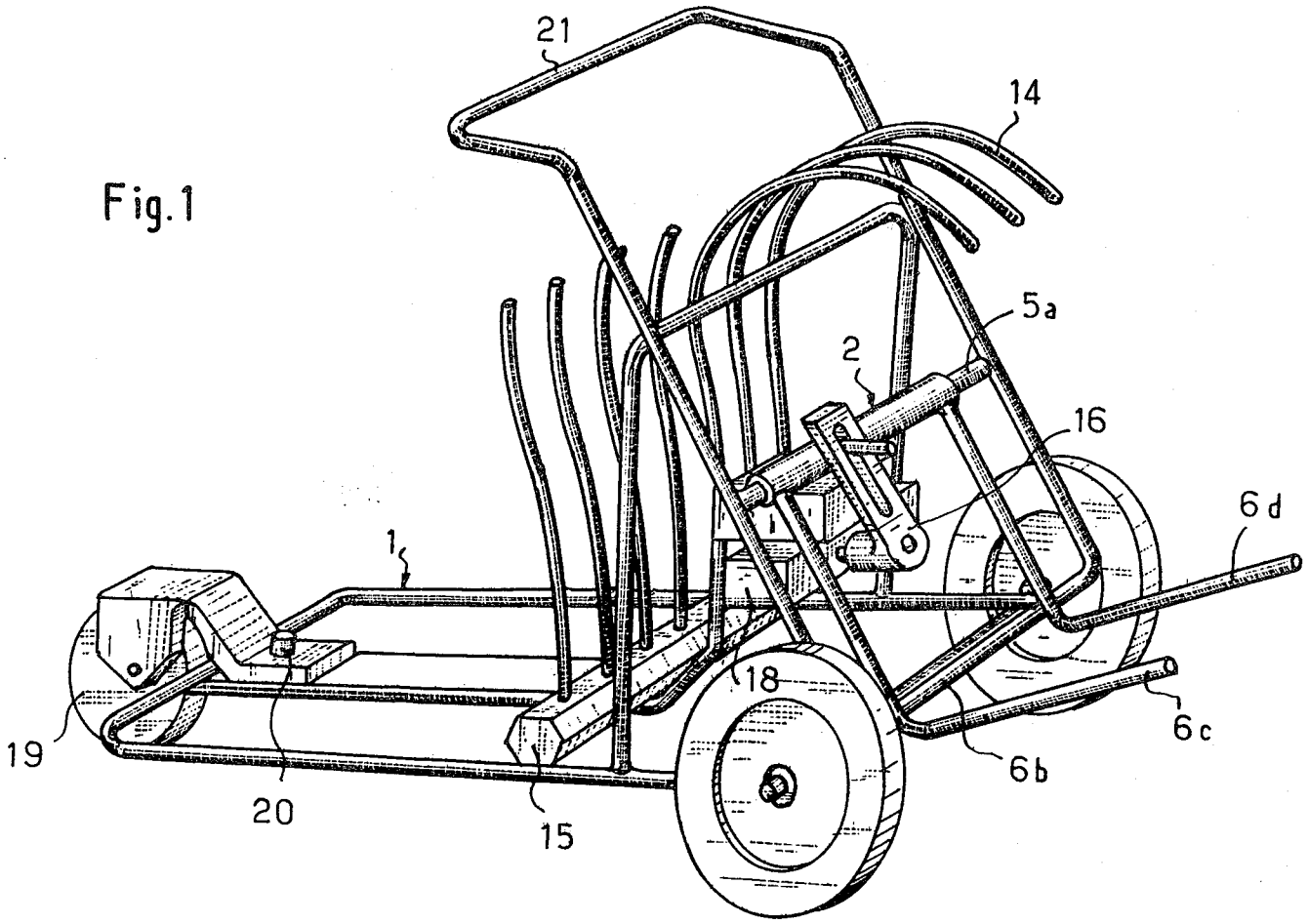
FIG. 1 shows diagrammatically a perspective view of the machine according to the invention, with the battery of nozzles removed.
Figure 2:
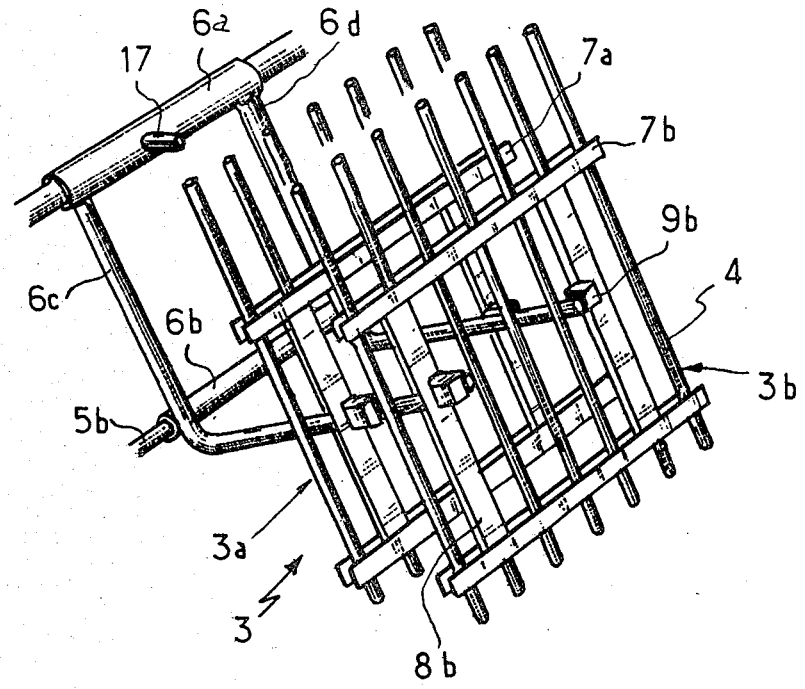
FIG. 2 shows the slider of the machine, adding thereto a battery with two aprons.
Figure 3:
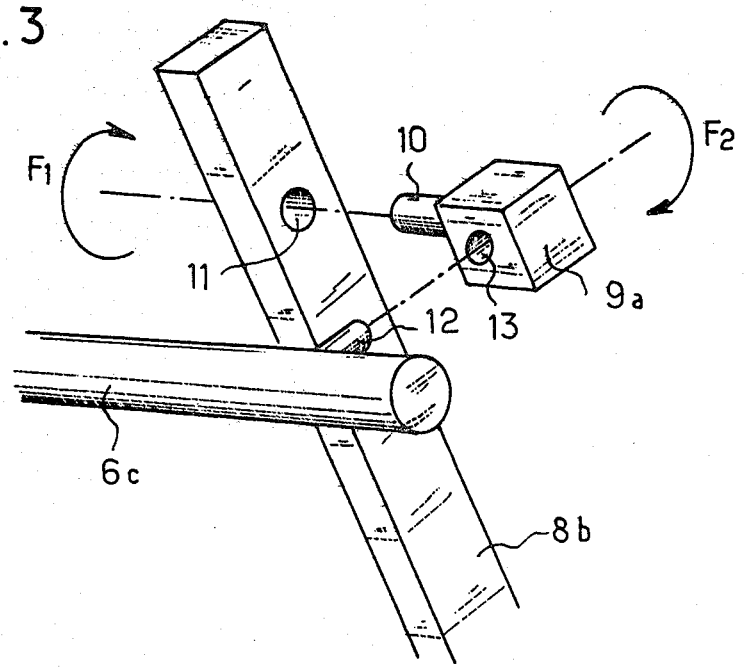
FIG. 3 shows in exploded perspective view, the assembly between the upright of an apron, the corresponding advanced arm of the slider and the pivoting block associated therewith.

It should understood however that the above-mentioned drawings and the corresponding descriptions, are given purely by way of illustration of the invention and are not intended to constitute any limitation thereof.

In these Figures there is seen at 1, the carriage of the machine on which the slider 2 is mounted, whose upper cross-member 6*a* is capable of a pulling to-and-fro movement on the fixed slide 5*a* integral with the carriage. A second cross-member 6*b* parallel to the first, moves, like the first, on a slide or guide 5*b*.

The slider includes also, a driving finger 17, by means of which the lever 16, driven with a pivoting motion actuated by a motor (not shown) and provided with an axial slot, enables said slider 2 to be driven.

The latter includes two arms, 6*c* and 6*d*, whose ends are directed towards the front of the carriage, which arms are designed to support the battery of nozzles. There is shown, at 3, the battery concerned, which includes two aprons, respectively 3*a* and 3*b*.

At 4 is seen one of the nozzles, connected to the distributor 15 by means of a flexible pipe, such as 14, capable of withstanding the very high pressure of the fluid within it.

At 7*a* and 7*b* are seen two of the cross-members of the nozzle-holding aprons. To simplify the drawing, the couplings of the various nozzles to their cross-members are not shown but it is of course well understood that these couplings are such that they enable the adjustment, both in height as well as in spacing and in inclination, left and right, of the various nozzles.

At 8*a* and 8*b* are seen two of the uprights of the aprons, which uprights are designed to cooperate with pivoting blocks such as 9*a*. Each of these blocks includes on the one hand, an axle 10 to which a housing 11 formed in the corresponding upright corresponds, said finger 17 enabling pivoting in the direction of the arrow F1 of said upright 8*b* around the block 9*a*.

In addition, the same block includes a housing 13 into which extends an axle 12 integral with arm 6*c* of the slider, said axle 12 and its housing 13 having a substantially horizontal direction and perpendicular to the axle 10. This enables said block 9*a* to pivot according to arrow F2 around the axle 12, whilst driving, in this movement, the corresponding apron, through the upright 8*b*.

At 9*a* and 9*b* are shown two pivoting blocks of the apron 3*b*.

At 18 is shown the box containing the motor for driving the lever 16.

At 19 is seen the rear wheel of the carriage, which wheel is pivotable around the axle 20.

For purposes of simplification, the inlet of the fluid under pressure to the distributor 15 has not been shown, nor has the device for actuating and controlling this fluid, which device could, for example, be mounted on the handlebar 21 of the carriage of the machine. Also by way of simplification, the device for interrupting the control of the motor has not been shown either; this can, for example, also be mounted on the handlebar 21 of the carriage of the machine.

Moreover suitable nozzle tips with which each nozzle can be equipped has not been shown either; these tips can for example have a round jet or a flat jet and, in the latter case, the aperture angle can vary from 20° to 90°, for example.

As for the delivery rate of the fluid, it may be, for example, of the order of 22 liters/minute per nozzle tip, which is easily equivalent to increase tenfold the efficiency of the existing devices with a single nozzle. Of course, the delivery rate of the fluid can be different from that indicated above, according to the type of nozzle tip used.

Figure 4:
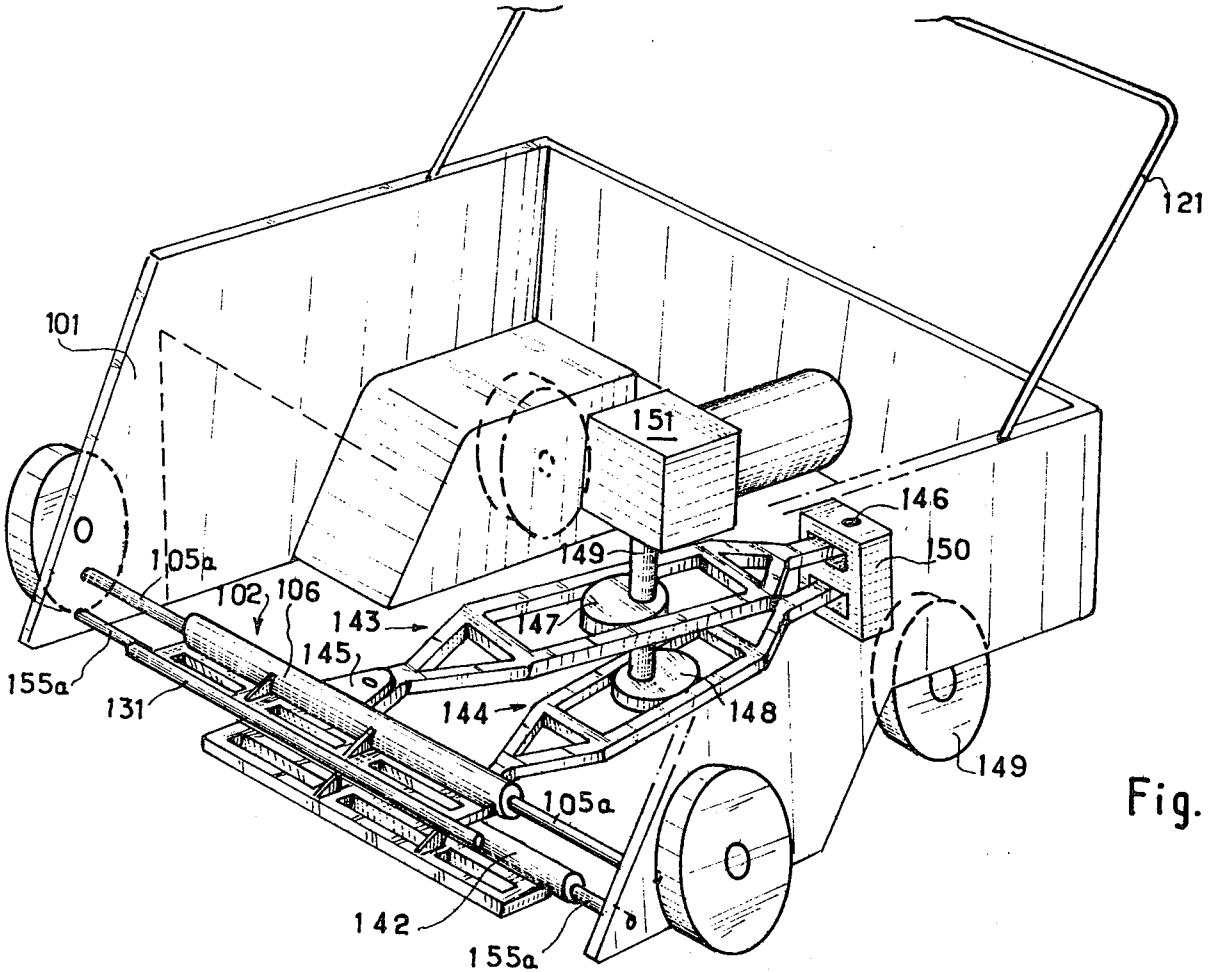
FIG. 4 is another perspective view of the machine, with the nozzle system removed.
Figure 6:
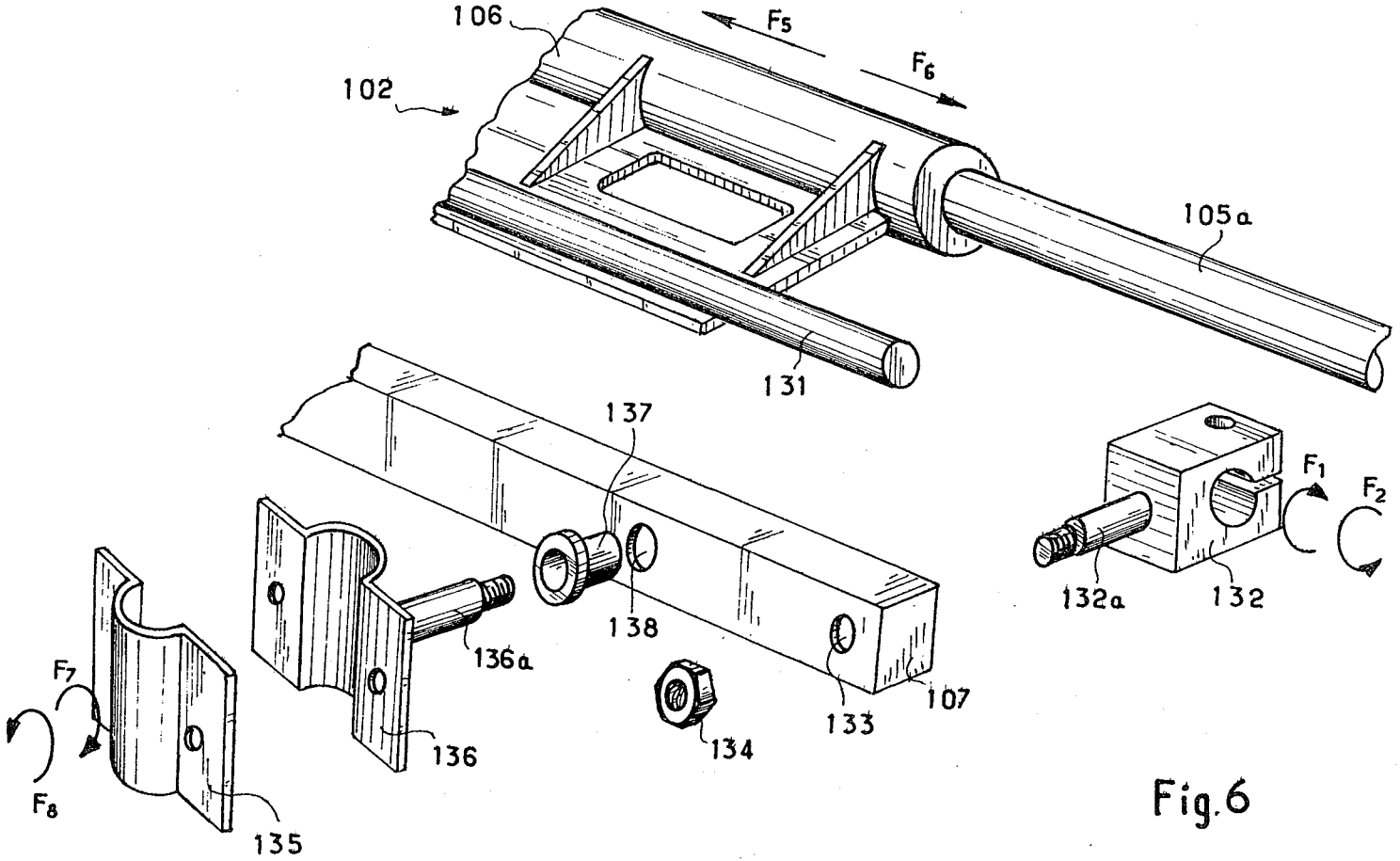

In FIG. 4 is seen the carriage 101 with its four wheels: two wheels on the ground at the front, two driving and steering wheels at the back, for example, The slider 106, oscillating transverselly on the fixed slide 105*a* includes, at the front, a horizontal axle 131 parallel to said slider, on which axle is fixed the cross-member 107 by means of a block 132 pivoting along the arrows F1 and F2 of FIG. 6. Said block includes an axle 32*a* designed to penetrate into the bore 133 of the cross-member 107 and to be held here, for example, by means of the nut 134 which is screwed onto the front threaded bush of said axle 132*a*. On its side, the cross-member 107 supports the two half-sleeves 135 and 136 respectively, the latter bearing the axle 136*a* perpendicular to the cross-member 107, which axle is pivotably mounted outside the coaxial barrel 137, which latter is fixed permanently inside the corresponding bore 138 of the cross-member 107. Thus the continual oscillating movement along the arrows F5 and F6 of the slider is translated by a swinging of the nozzles, each nozzle pivoting thus along the arrows F7,F8 of FIG. 6 around the axle of the corresponding barrel 137.

As for the horizontal to-and-fro movement of the sliders 106 and 142, it is actuated by the respective arms 143 and 144 each hinged in a yoke borne by the slider which drives it, of which yokes only that which is denoted by the reference 145 visible in FIG. 4 and belonging to the slider 106, can be seen.

The rear end of each of the two arms 143 and 144 is arranged so as to penetrate inside the box 150 shown in FIG. 4, and this so that it is free to slide, on demand, in an alternating forward and backward movement, the two arms being supported by a ball joint (not shown) contained in said box.

At 151 is shown the box containing the driving bevel gear of the shaft 149, the motor designed to rotate this shaft not being shown, nor the corresponding transmission; said motor can, moreover, easily be a hydraulic or pneumatic jack.

Figure 5:
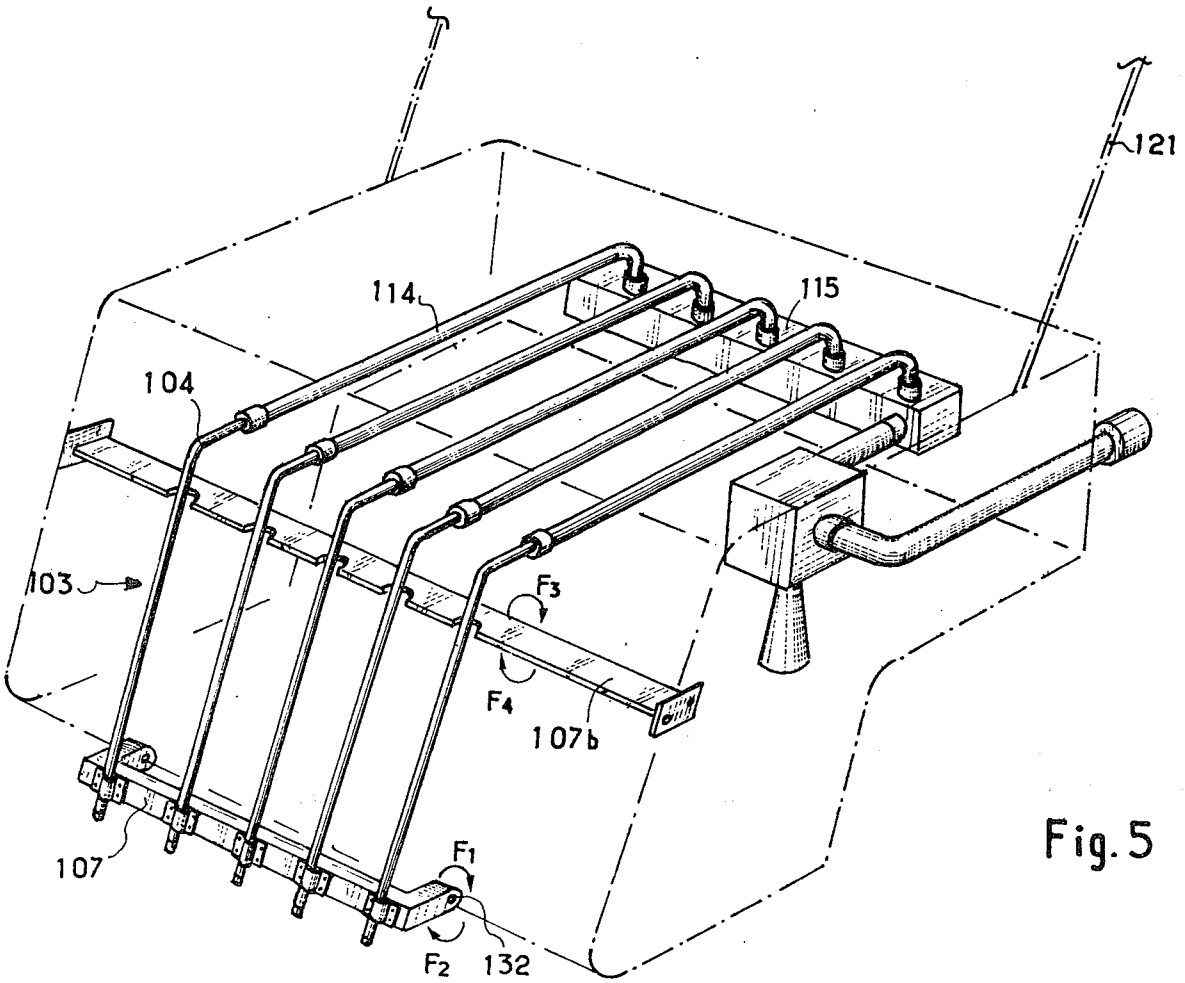
FIG. 5, completing the foregoing one, shows the assembly of nozzles and corresponding cross-members, and and FIG. 6 shows details of the nozzle-holding slider and its cross-member.

As for the angular spacing between the two cams 147 and 148, it can be adjusted as desired so as to give a phase staggering between the motion of the two arms 143 and 144, a value insuring the optimum balancing of the load of the movable assembly. It is to be noted that the fixed upper cross-member 107*b* shown in FIG. 5 may be made to pivot in the direction of the arrows F3 and F4, in order to correspond to the various positions that the nozzles 104 could assume.

According to one feature of the invention, the amplitude of the continual angular oscillating movement of the nozzles is about plus or minus 30° around the median position of the nozzles. It is also specified that the amplitude of the oscillating angular movement of the nozzles is about plus or minus 60° with respect to the median position of the latter. It should noted in addition that by reason of the combination of the lateral to-and-fro translation movement of the slider and of the oscillating movement of the nozzles, the end of each of the latter describes a flattened curved path in space.

It is also possible to give the nozzles an arcuate form, in their longitudinal median plane, in order to facilitate the flow of the high pressure fluid.

As described, the scouring machine according to the invention has a very great working efficiency, the combined whip and scraper blade effect imparted by these nozzles to the high pressure fluid producing an effect similar to that of machining by planing.

As emerges from the foregoing, the invention is in no way limited to those of its embodiments and forms of application which have just been described more explicitly; it encompasses on the contrary, all modifications which may occur to the technician skilled in the art, without departing from the scope of the present invention.

Thus it will be possible to add to the machine a heat exchanger arranged in the path of the very high pressure fluid, upstream of the distributor of the machine, by means of which exchanger said fluid could have its temperature of use brought to a predetermined value, above ambient temperature.

Thus also the scouring machine according to the present invention, could include besides the one or more batteries of nozzles arranged preferably at the front of the machine, a set of dismountable vertical or lateral brushes, arranged at the rear of the machine or in the median part of the latter. The carriage of the machine according to the present invention could be equipped with any known means making it movable both on a horizontal plane, as previously explained, and on any oblique and even vertical plane.

I claim:

1. An all purpose scouring machine comprising: a travelling carriage having a median plane;

at least one horizontal axle mounted on said carriage and extending transverse to said median plane;

a slider movably mounted on each said axle;

at least one nozzle holder apron mounted on said slider, each said apron comprising at least two cross members;

a plurality of parallel nozzles pivotally fixed to said cross members of each said nozzle holder apron;

means for supplying said nozzles with high pressure fluid;

motor means on said carriage; and drive means connected between said motor means and each said nozzle holder apron for reciprocally moving each said nozzle holder apron along a respective said axle, whereby the reciprocal movement of each said slider reciprocates said parallel nozzles in transverse motion on either side of said median plane.

2. The machine of claim 1 wherein one of each said cross members is fixed to said carriage, whereby said plurality of nozzles pivot about said fixed cross member.

3. The machine of claim 1 wherein each said slider includes two forwardly extending arms, and wherein each said arm is articulated with one said apron via articulation means having at least two degrees of freedom, each said articulation means comprising a pivoting block including:

a second axle perpendicular to said apron and pivoted thereto; and a housing receiving said second axle and being fixed to one of said two arms, said housing extending horizontally and substantially perpendicular to said second axle, wherein each said apron is adapted to pivot on said second axle by at least 30° on either side of said median plane.

4. The machine of claim 1 wherein said drive means are adapted to reciprocate said nozzles by 30° on either side of said median plane.

5. The machine of claim 1 wherein said slider comprises two sliders.

6. The machine of claim 1 wherein said drive means comprises:

a vertical axle fixed to the rear of said carriage;

a horizontal arm for each said slider, each said horizontal arm having one end pivoted to said vertical axle and another end connected to one said slider;

a vertical shaft rotatably driven by said motor means; and cam means for each said horizontal arm, each said cam means rotating about the axis of said vertical shaft and operatively engaging one of said horizontal arms.

7. The machine of claim 6, further comprising two cam means being adjustably angularly staggered.

8. The machine of claim 1 including:

a third transverse axle integral with said slider and parallel said cross member; and pivot block means connecting each end of said third axle to said cross member, each said pivot block means being adapted to permit to said cross member to pivot about said third axle by no more than 60° from a horizontal plane.

9. The machine of claim 1 wherein said means for supplying includes at least one heat exchanger.

10. The machine according to claim 1, wherein said nozzles are adjustable in height on respective said cross-members.

11. The machine according to claim 1 wherein said nozzles are adjustable in spacing on said respective cross-members.

12. The machine according to claim 1 wherein said nozzles have arcuate shapes, in their respective longitudinal median planes.

13. The machine according to claim 8 wherein each of said nozzles is assembled to one said cross-member attached to said third transverse axle by means of an assembly comprising a front half-sleeve and a rear half-sleeve bearing a fourth axle perpendicular to said cross-member, said fourth axle being pivotable in a coaxial barrel fixed inside a bore in said cross-member.

14. The machine according to claim 1 wherein nozzle tips at the ends of said nozzles are of the rotary type.

15. The machine according to claim 1 wherein said motor is a double-acting jack.

16. The machine according to claim 1 wherein said motor is associated with a lever pivoting around a fixed point integral with the carriage, said lever cooperating with a finger integral with said at least one slider.

* * * * *